US006788257B2

(12) United States Patent
Fang et al.

(10) Patent No.: US 6,788,257 B2
(45) Date of Patent: Sep. 7, 2004

(54) DUAL-FREQUENCY PLANAR ANTENNA

(75) Inventors: Shyh-Tirng Fang, Tainan (TW); Shih-Huang Yeh, Douliou (TW); Kin-Lu Wong, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/259,445

(22) Filed: Sep. 30, 2002

(65) Prior Publication Data

US 2003/0122718 A1 Jul. 3, 2003

(30) Foreign Application Priority Data

Dec. 27, 2001 (TW) ..... 90132623 A

(51) Int. Cl.[7] ..... H01Q 1/38
(52) U.S. Cl. ..... 343/700 MS; 343/702
(58) Field of Search ..... 343/700 MS, 702, 343/846, 848; H01Q 1/38

(56) References Cited

U.S. PATENT DOCUMENTS

| | | | | | |
|---|---|---|---|---|---|
| 4,821,040 | A | * | 4/1989 | Johnson et al. | 343/700 MS |
| 5,627,550 | A | * | 5/1997 | Sanad | 343/700 MS |
| 5,786,793 | A | * | 7/1998 | Maeda et al. | 343/700 MS |
| 6,552,686 | B2 | * | 4/2003 | Ollikainen et al. | 343/700 MS |
| 6,608,594 | B1 | * | 8/2003 | Kane et al. | 343/700 MS |

* cited by examiner

*Primary Examiner*—Hoanganh Le
(74) *Attorney, Agent, or Firm*—Rabin & Berdo, P.C.

(57) ABSTRACT

A dual-frequency planar antenna disclosed herein utilizes a main radiating device to produce a resonance mode and excites a parasitic radiating device to produce another resonance mode by the coupling of energy. These two modes can provide sufficiently broad bandwidths, and the present invention is simple in design, which makes it cost effective. Therefore, the planar antenna of the present invention is a competitive alternative for wireless communication applications.

35 Claims, 7 Drawing Sheets

DUAL-FREQUENCY PLANAR ANTENNA

This application incorporates by reference Taiwan application Serial No. 090132623, filed Dec. 27, 2001.

BACKGROUND OF THE INVENTION

1. Field of the Invention

The invention relates in general to a planar antenna, and more particularly to a planar inverted-F antenna of dual frequencies.

2. Description of the Related Art

Due to developments in communications technology, various wireless products are produced in great quantities. Recently, the Bluetooth system has been developed to enable communications between electronic products, such as computers, printers, digital cameras, refrigerators, TVs, air conditioners, and other wireless products. The frequency range of the ISM (Industrial Scientific Medical) band for Bluetooth is 2.4 to 2.4835 GHz. If more and more wireless products employ the Bluetooth system, the single frequency band of the ISM will not sufficiently support the large volume and transmission rate. The same situation also happens in the other wireless communication systems of ISM 2.4 GHz, such as WLAN (wireless local area network) and HomeRF (Home radio frequency).

Therefore, a dual-frequency antenna has been developed to reduce the volume of the wireless communication products by combining two frequencies in an antenna. Furthermore, the product of a dual-frequency antenna will be more competitive if the size of the dual-frequency antenna is minimized. Accordingly, a PIFA (planar inverted-F antenna) is developed to decrease the amount of space occupied, wherein the length of the PIFA is reduced to $\lambda/4$, instead of $\lambda/2$, which is the length of the traditional planar antenna. This reduction in the size of the planar antenna makes it possible to be concealed within most of the present-day communication devices.

Please refer to FIG. 1, which shows the structure of a PIFA (planar inverted-F antenna) according to a traditional design. The PIFA 100 is composed of a radiator 110, a grounding plane 130, a medium 150, a shorting pin 170, and a feeding means 190. The medium 150 is used to separate the radiator 110 and the grounding plane 130, and is positioned between the two. The material of medium 150 can be air, dielectric substrate, or the combination of them. The radiator 110 is coupled to the grounding plane 130 by the shorting pin 170, which is made of metal. The feeding means 190, such as SMA connector, can be equipped on the ground and coupled to the radiator 110 to deliver the microwave signal. The radiator 110 and the grounding plane 130 are made of metal, wherein the radiator 110 can be of various patterns, according to the different requirements.

Basically, the structures of each PIFA are the same, for instance, the separation of the grounding plane and the radiator by the medium, the coupling of the radiator to the grounding plane by the shorting pin, and the coupling of the feeding means 190 to the radiator. The operational characteristic of the PIFA is determined by the pattern of the radiator. Shown in FIG. 2A is the radiator pattern of a PIFA with dual frequencies, according to a traditional design. The grounding point 271 and the feeding point 291 are, respectively, the parts of the shorting pin contacting with the radiator 210A and the feeding means contacting with the radiator 210A, wherein the former is represented by a square and the latter is represented by a circle. The same representations for the grounding point and the feeding point are used in the following figures.

In FIG. 2A, an L-shaped slit is embedded in the radiator 210A, wherein two surface current paths of L1 and L2 for the dual frequencies are formed. The radiator 210A resonates at the higher frequency, such as 5.8 GHz, with the shorter path L1, and resonates at the lower frequency, for instance 2.4 GHz, with the longer path L2.

Please refer to FIG. 2B, which shows a PIFA of dual frequencies according to another traditional design. As the radiator 210B is excited, the U-shaped slot is responsible for the formation of two current paths in the radiator 210B, wherein the shorter current path L1 produces the higher frequency and the longer current path L2 produces the lower frequency.

The detailed configurations of the PIFAs in FIG. 2A and FIG. 2B are disclosed in "New slot configurations for dual-band planar inverted-F antenna", Microwave Optical Technology Letters, vol. 28, No. 5, Mar. 5, 2001, pp. 293–298. Such kinds of dual-band PIFA usually cannot afford a sufficiently broad bandwidth. In U.S. Pat. No. 5,764,190, the inverter-F antenna is designed using the capacitive effect or a capacitive feed, which can provide an adequate bandwidth. However, this design is relatively very complicated and the fabrication cost is very high.

To solve the problems mentioned above, the present invention discloses a PIFA with broad bandwidth, simple structure, and low cost.

SUMMARY OF THE INVENTION

It is therefore an object of the invention to provide a dual-frequency PIFA with the advantages of broad bandwidth and simple structure.

In accordance with the object of the invention, a dual-frequency PIFA is disclosed, wherein the said PIFA has a first operational band, such as 2.4 GHz ISM band, and a second operational band, such as 5.8 GHz ISM band. The dual frequency PIFA comprises a grounding plane, a main radiating device, a parasitic radiating device, a medium, two shorting pins and a feeding means, wherein the main radiating device and the parasitic radiating device are coupled to the grounding plane through shorting pins, respectively. The feeding means positioned on the grounding plane is coupled to the main radiating device for transferring the microwave signal. The excitation of the main radiating device triggers the excitation of the parasitic radiating device by the coupling of the electromagnetic energy. The first resonance mode of the main radiating device enables the PIFA to operate in the first operational band and the first resonance mode of the parasitic radiating device enables the PIFA to operate in the second operational band. Thus, the PIFA can operate in dual frequencies.

Please note that the structure of the present invention is not limited to the PIFA. It is also applicable in a planar antenna.

BRIEF DESCRIPTION OF THE DRAWINGS

Other objects, features, and advantages of the invention will become apparent from the following detailed description of the preferred but non-limiting embodiments. The description is made with reference to the accompanying drawings.

DESCRIPTION OF THE PREFERRED EMBODIMENT

In the present invention, the radiator of the PIFA (planar inverted-F antenna) consists of a main radiating device and a parasitic radiating device, wherein the main radiating device is equipped with a feeding means. As the main radiating device is excited, some part of the energy of the electromagnetic wave is coupled to the parasitic radiating device. Then, the parasitic radiating device is also excited, and the PIFA can operate in dual frequencies, wherein the band of the first frequency is operated in the first resonance mode of the main radiating device and the band of the second frequency is operated in the first resonance mode of the parasitic radiating device. Please note that the characteristics of the present invention are not limited to the PIFA, and it is also applicable in any planar antenna operated in dual frequencies.

For example, consider the ISM band. To produce the operational band of 2.4 GHz (2400~2500 MHZ), the parasitic radiating device is excited by the main radiating device through the coupling of the electromagnetic wave. The operational band of 5.8 GHz (5725~5850 MHz) is produced by exciting the main radiating device. The bandwidth of the 2.4 GHz and the 5.8 GHz are both wide enough for use.

Figure 1:
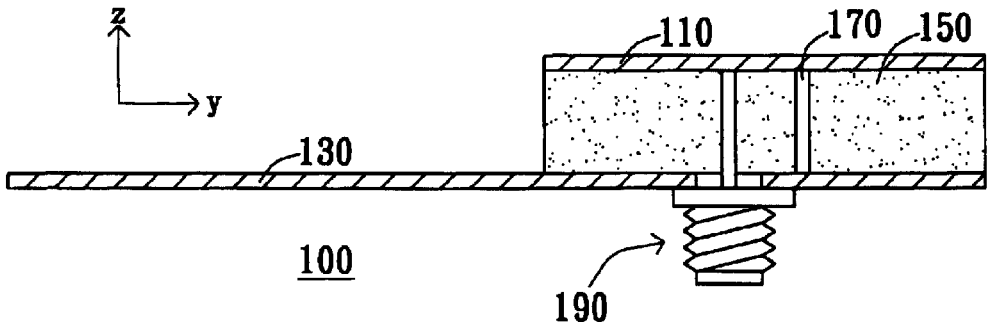
FIG. 1 (PRIOR ART)
FIG. 1 it shows a structure of the PIFA according to a traditional design.
Figure 2A:
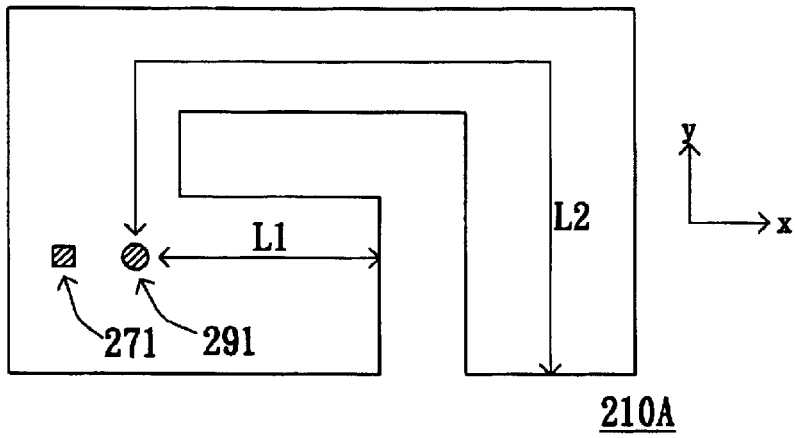
FIG. 2A (PRIOR ART)
FIG. 2A shows the radiator pattern of the PIFA with dual frequencies according to a traditional design.
Figure 2B:
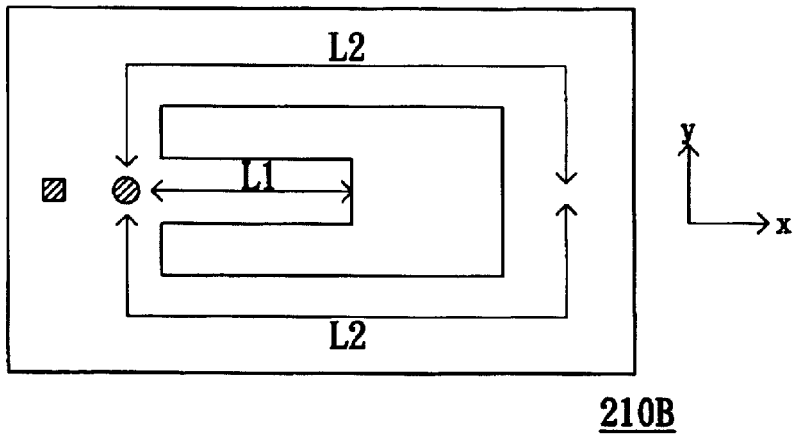
FIG. 2B (PRIOR ART)
FIG. 2B shows a PIFA of dual frequencies according to another traditional design.
Figure 3:
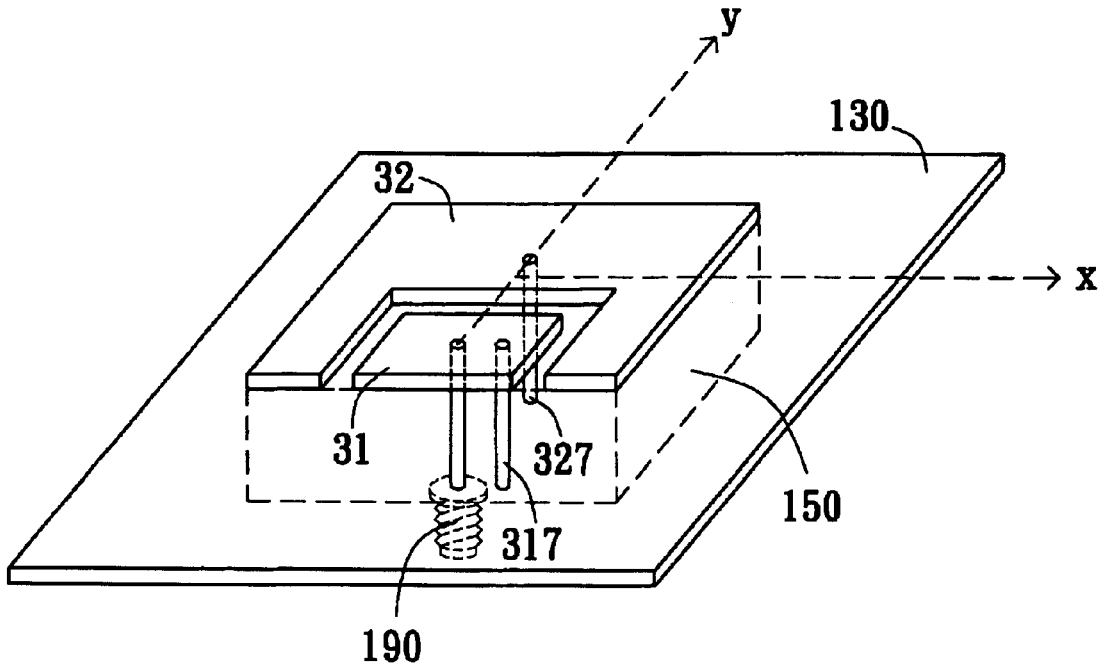
FIG. 3 shows a dual-frequency PIFA according to a preferred embodiment of the present invention.
Figure 3:
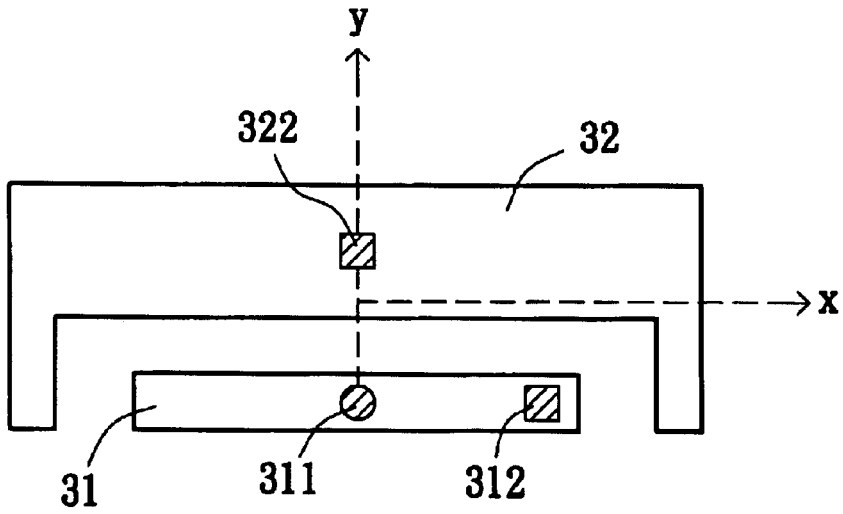

Please refer to FIG. 3, which shows a dual-frequency PIFA according to a preferred embodiment of the present invention. The basic structure is similar to that of the traditional design, wherein a medium 150 is positioned between a grounding plane 130 and a radiator, and is composed of air and a microwave substrate. In addition, the radiator of the present invention consists of a main radiating device 31 and a parasitic radiating device 32, wherein the parasitic radiating device 32 has a concave side which is opposite and partially surrounds the main radiating 31, as shown in FIG. 3.

The main radiating device 31 and the parasitic radiating device 32 are coupled to the grounding plane 130 through shorting pin 317 and shorting pin 327, respectively. The shorting pin 317 and the shorting pin 327 are made of a metal pin. The grounding point 312 is the part of the shorting pin 317 contacting with the main radiating device 31, and the grounding point 322 is the part of the shorting pin 327 contacting with the parasitic radiating device 32.

Please note that a feeding means 190, equipped on the grounding plane 130, is a SMA connector and is only coupled to the main radiating device 31, wherein a feeding point 311 is the point of feeding means 190 connecting to the main radiating device 31. After a microwave signal is fed into the main radiating device 31 through the feeding means 190, the main radiating device 31 is excited. The electromagnetic energy is coupled to the parasitic radiating device 32 by irradiating, and the parasitic radiating device 32 is then excited. Therefore, the PIFA of the present invention has the characteristics of dual frequencies.

As shown in FIG. 3, the main radiating device 31 is smaller than the parasitic radiating device 32. Both of the main radiating device 31 and the parasitic radiating device 32 resonate at $\lambda/4$, and thus the former provides the operational bandwidth of higher frequency, such as 5.8 GHz, and the latter provides the operational bandwidth of lower frequency, such as 2.4 GHz. While the main radiating device 31 is larger than the main radiating device 32, the former and the latter provide the operational bandwidth of lower frequency and higher frequency, respectively.

Figure 4:
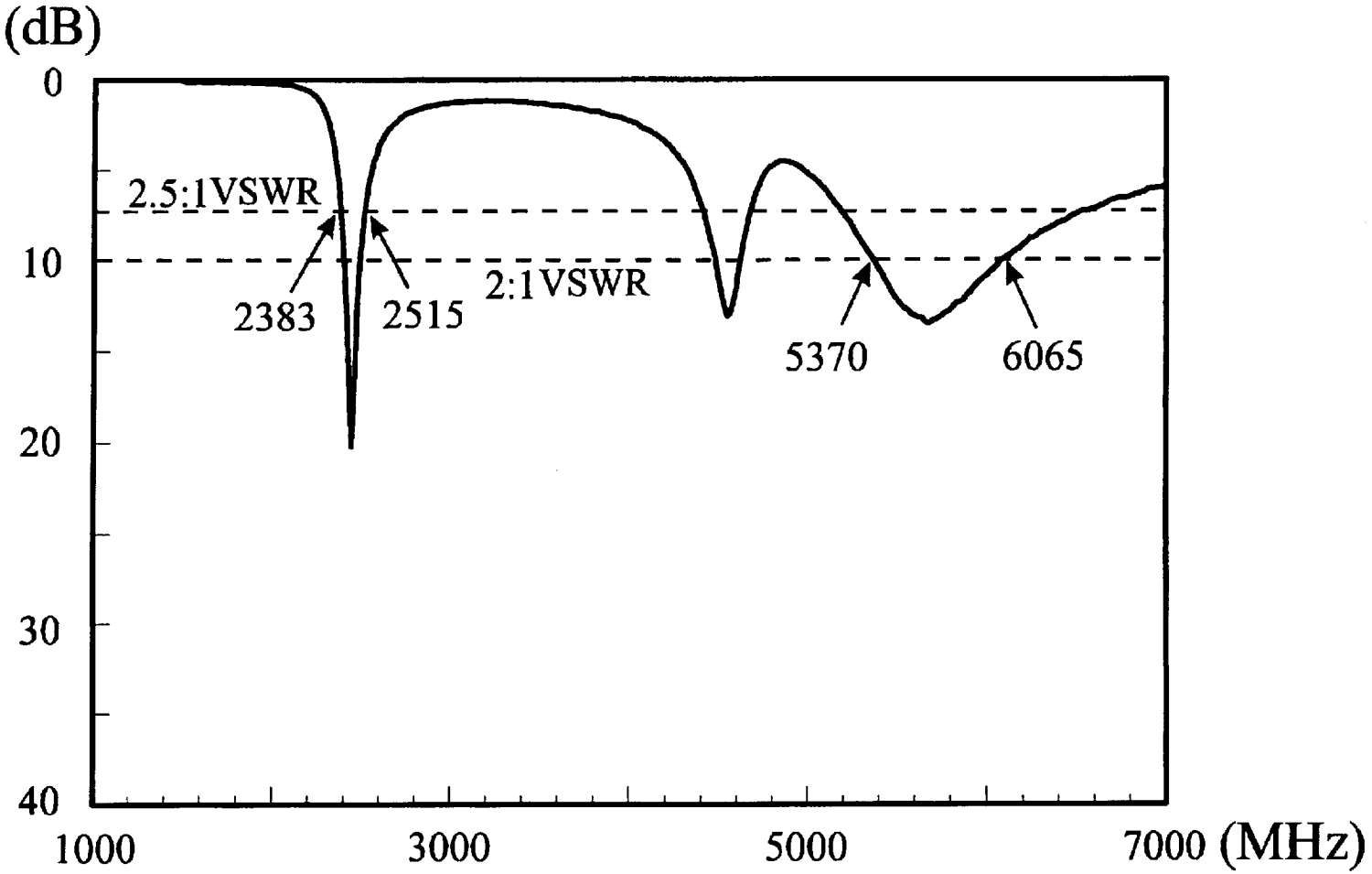
FIG. 4 shows the return loss of the PIFA according to the preferred embodiment of the present invention.

Referring to FIG. 4, it shows the return loss of the PIFA according to a preferred embodiment of the present invention. With the parasitic radiating device, the PIFA operates in the 2.4 GHz band, which is the first resonance mode of the parasitic radiating device and has a bandwidth of 132 MHz (2383~2515 MHz) according to the definition of an impedance bandwidth in 1:2.5 VSWR. With the main radiating device, the PIFA operates in the 5.8 GHz band, which is the first resonance mode of the main radiating device and has a bandwidth of 695 MHz (5370~6065 MHz) according to the definition of an impedance bandwidth in 2:1 VSWR. These two modes of the present invention resonate in $\lambda/4$, and the characteristics of the corresponding antennas are improved.

Figure 5A:
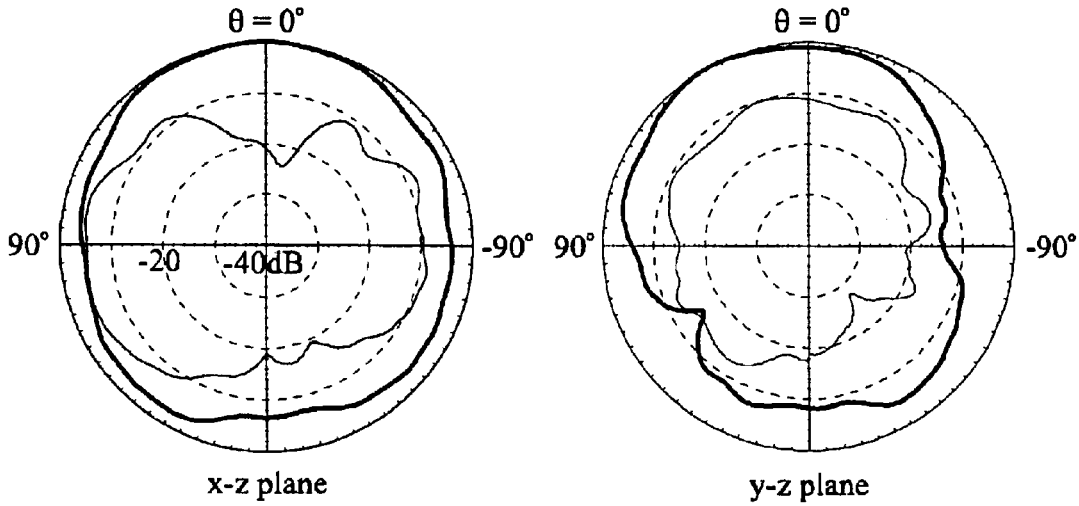
FIG. 5A shows the measurements of the H-plane radiating pattern and E-plane radiating pattern as the PIFA operates at 2.4 GHz according to the preferred embodiment of the present invention.

Referring to FIG. 5A, it shows the measurements of the H-plane and E-plane radiating patterns as the PIFA operates at 2.4 GHz, wherein the principal polarization pattern is represented by the thicker line and the cross polarization pattern is represented by the thinner line. Additionally, the H-plane is the x-z plane and the E-plane is the y-z plane.

Figure 5B:
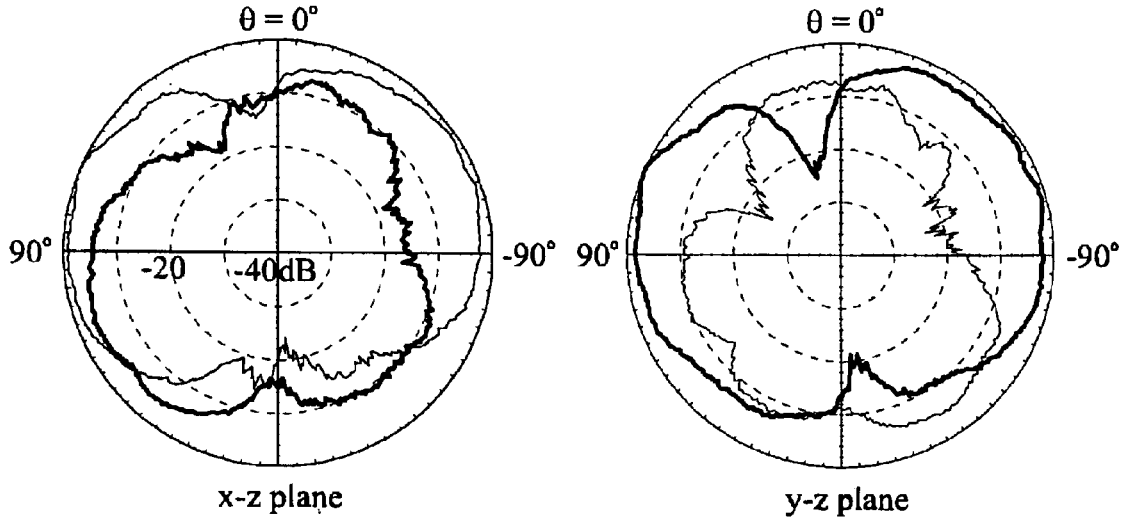
FIG. 5B shows the measurements of the H-plane and E-plane radiating patterns as the PIFA operates at 5.8 GHz according to the preferred embodiment of the present invention.
Figure 6A:
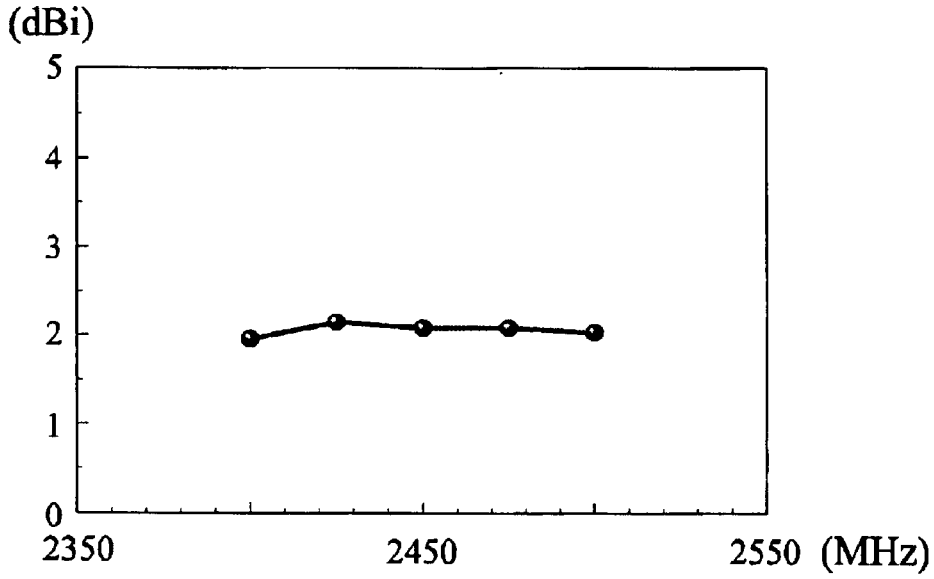
FIG. 6A shows the relationship between gain and frequency as the PIFA operates in the 2.4 GHz band according to the preferred embodiment of the present invention.
Figure 6B:
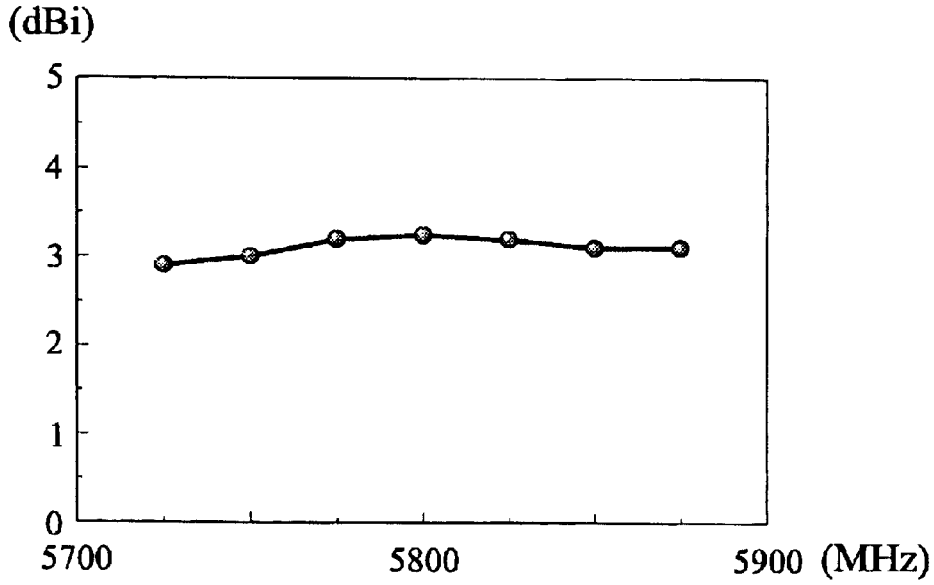
FIG. 6B shows the relationship between gain and frequency as the PIFA operates in the 5.8 GHz band according to the preferred embodiment of the present invention.

Referring to FIG. 5B, it shows the measurements of the H-plane and E-plane radiating patterns as the PIFA operates at 5.8 GHz. As in FIG. 5A, the principal polarization pattern and the cross polarization pattern are represented by the thicker line and the thinner line, and the H-plane and the E-plane are the x-z plane and the y-z plane, respectively. Please refer to FIG. 6A and FIG. 6B, they show the relationship of the gain and the frequency as the PIFA operates in the 2.4 GHz and 5.8 GHz bands, respectively.

Figure 7:
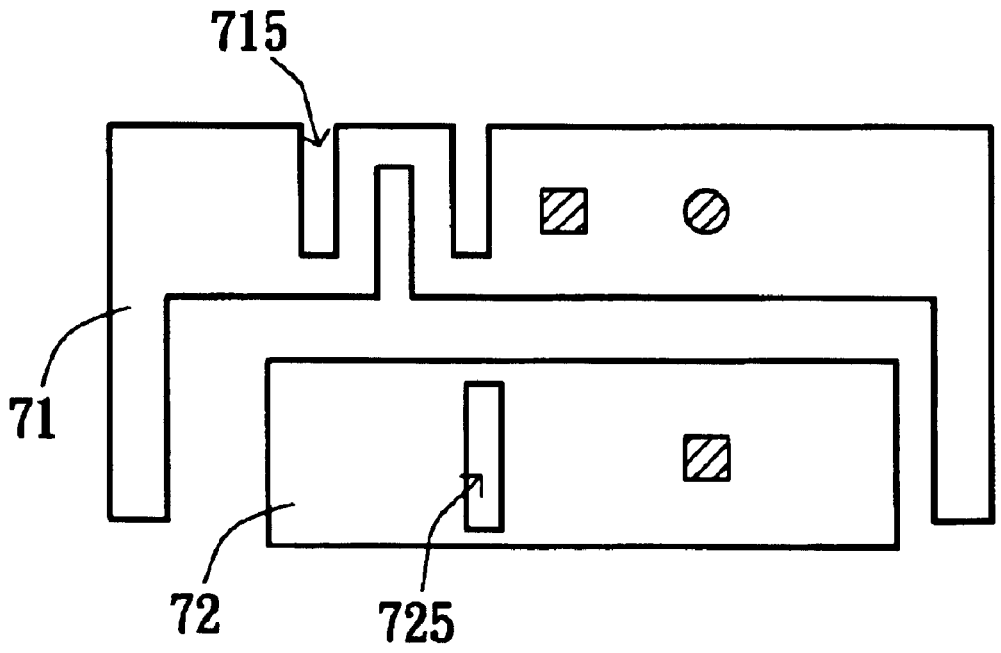
FIG. 7 shows the condition that a slot is embedded in the radiator according to the preferred embodiment of the present invention.

Referring to FIG. 7, which shows the condition that slits 715 are embedded in the main radiator, wherein the path of the exciting surface current path is lengthened and the resonance frequency is decreased. To maintain a constant resonance frequency, the size of the radiator embedded with slits will be smaller than that of the radiator without slits. Therefore, the volume of the PIFA can be decreased by applying a slot. For the same reason, the size of parasitic radiating device 72 will be decreased and the path of the exciting surface current will be lengthened by embedding a rectangular slot 725 therein. Please note that, in FIG. 7, the resonance frequency of the main radiating device 71 is lower than that of the parasitic radiating device 72 due to the difference of their sizes. In addition, the main radiating device 71 has a concave side which is opposite and partially surrounds the parasitic radiating device 71, as shown in FIG. 7.

Figure 8A:
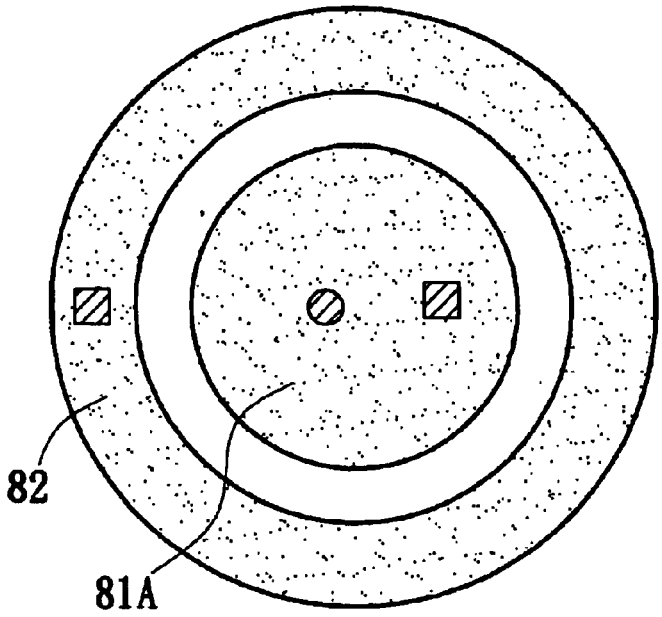
FIG. 8A shows the structure that the main radiating device is circular and the parasitic radiating device is annular according to the preferred embodiment of the present invention.
Figure 8B:
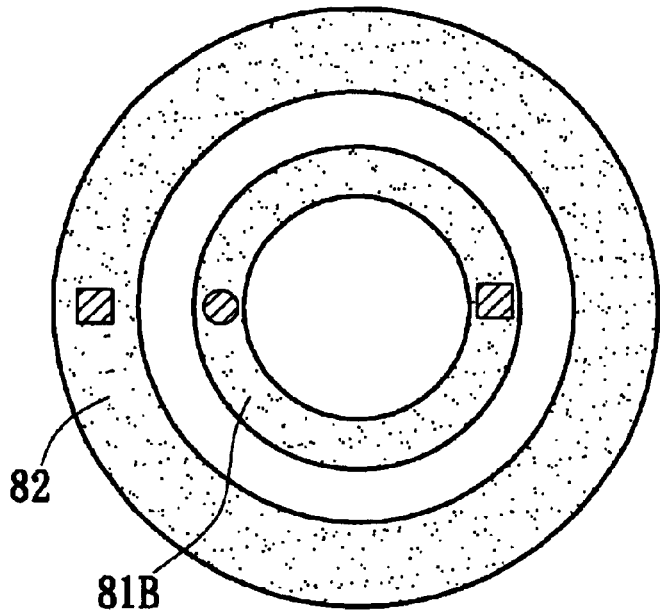
FIG. 8B shows the structure that the main radiating device is a smaller annular structure and the parasitic radiating device is a larger annular structure according to the preferred embodiment of the present invention.

Besides a rectangular shape, the radiating device can be implemented by another shape. For instance, as shown in FIG. 8A, the main radiating device 81A is circular and the parasitic radiating device 82 is annular to surround the main radiating device 81A. In FIG. 8B, the main radiating device 81B is a smaller annular structure and the parasitic radiating device 82 is a larger annular structure surrounding the main radiating device 81B.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dual-frequency (planar antenna) capable of operating in a first operation band and in a second operation band, said dual-frequency planar antenna comprising:

a grounding plane;

a main radiating device coupled to said grounding plane, said main radiating device having a first resonance mode of said main radiating device such that said dual-frequency antenna is capable of operating in said first operation band;

a feeding means provided on said grounding plane, said feeding means being coupled to said main radiating device to transfer a microwave signal to said main radiating device;

a parasitic radiating device coupled to said grounding plane, said parasitic radiating device having a concave side opposite said main radiating device and a first resonance mode of said parasitic radiating device such that said dual-frequency antenna is capable of operating in said second operation band, wherein said concave side partially surrounds said main radiating device and said first resonance mode of said parasitic radiating device is excited by the coupling of energy from said main radiating device; and a medium positioned between said main radiating device, said parasitic radiating device, and said grounding plane for isolating purpose;

wherein said main radiating device and said parasitic radiating device have a first size and a second size different from the first size, respectively; said first and said second operation bands are of a first operating frequency and a second operating frequency different from the first operating frequency, respectively; and said first and said second sizes are inversely related to said first and said second operating frequencies, respectively.

2. A dual-frequency antenna according to claim 1, wherein said main radiating device is rectangular.

3. A dual-frequency antenna according to claim 2, wherein said main radiating device further comprises a slot.

4. A dual-frequency antenna according to claim 2, wherein said main radiating device further comprises slits.

5. A dual-frequency antenna according to claim 1, wherein said parasitic radiating device has a U shape substantially and partiallly surrounds said main radiating device.

6. A dual-frequency antenna according to claim 5, wherein said parasitic radiating device further comprises a slot.

7. A dual-frequency antenna according to claim 5, wherein said parasitic radiating device further comprises slits.

8. A dual-frequency antenna according to claim 1, wherein said medium is air.

9. A dual-frequency antenna according to claim 1, wherein said medium is a substrate.

10. A dual-frequency antenna according to claim 1, wherein said main radiating device is coupled to said grounding plane through a first shorting pin, the first shorting pin being a metal pin.

11. A dual-frequency antenna according to claim 1, wherein said parasitic radiating device is coupled to said grounding plane through a second shorting pin, the second shorting pin being a metal pin.

12. A dual-frequency antenna according to claim 1, wherein said feeding means is a SMA connector.

13. A dual-frequency planar antenna according to claim 1, wherein said dual-frequency planar antenna is a planar inverted-F antenna.

14. A dual-frequency planar antenna according to claim 1, wherein said first operating frequency is substantially 5.8 GHz and said second operating frequency is substantially 2.4 GHz.

15. A dual-frequency planar antenna according to claim 14, wherein said first operation band is from 5370 to 6065 Mhz substantially.

16. A dual-frequency planar antenna according to claim 14, wherein said second operation band is from 2340 to 2500 Mhz substantially.

17. A dual-frequency planar antenna capable of operating in a first operation band and in a second operation band, said dual-frequency planar antenna comprising:

a grounding plane;

a main radiating device coupled to said grounding plane, said main radiating device having a concave side and a first resonance mode of said main radiating device such that said dual-frequency planar antenna is capable of operating in said first operation band;

a feeding means provided on said grounding plane, said feeding means coupled to said main radiating device to transfer a microwave signal to said main radiating device;

a parasitic radiating device coupled to said grounding plane and being opposite said concave side of said main radiating device, said parasitic radiating device having a first resonance mode of said parasitic radiating device such that said dual-frequency planar antenna is capable of operating in said second operation band, wherein said concave side of said main radiating device partially surrounds said parasitic radiating device and said first resonance mode of said parasitic radiating device is excited by the coupling of the energy from said main radiating device; and a medium positioned between said main radiating device, said parasitic radiating device, and said grounding plane for isolating purposes, wherein said main radiating device and said parasitic radiating device have a first size and a second size different from the first size, respectively; said first and said second operation bands are of a first operating frequency and a second operating frequency different from the first operating frequency, respectively; and said first and said second sizes are inversely related to said first and said second operating frequencies, respectively.

18. A dual-frequency planar antenna according to claim 17, wherein said main radiating device is a substantially U-shaped.

19. A dual-frequency planar antenna according to claim 18, wherein said main radiating device further comprises a slot.

20. A dual-frequency planar antenna according to claim 18, wherein said main radiating device further comprises slits.

21. A dual-frequency planar antenna according to claim 18, wherein said parasitic radiating device is substantially rectangular and is partially surrounded said main radiating device.

22. A dual-frequency planar antenna according to claim 21, wherein said parasitic radiating device further comprises a slot.

23. A dual-frequency planar antenna according to claim 21, wherein said parasitic radiating device further comprises slits.

24. A dual-frequency planar antenna according to claim 17, wherein said medium is air.

25. A dual-frequency planar antenna according to claim 17, wherein said medium is a substrate.

26. A dual-frequency planar antenna according to claim 17, wherein said feeding means is a SMA connector.

27. A dual-frequency planar antenna according to claim 17, wherein said parasitic radiating device is substantially rectangular.

28. A dual-frequency planar antenna according to claim 27, wherein said parasitic radiating device further comprises an opening.

29. A dual-frequency planar antenna according to claim 17, wherein said dual-frequency planar antenna is a planar inverted-F antenna.

30. A dual-frequency planar antenna according to claim 17, wherein said first operating frequency is substantially 2.4 GHz and said second operating frequency is substantially 5.8 GHz.

31. A dual-frequency planar antenna according to claim 30, wherein said first operation band is from 2340 to 2500 Mhz substantially.

32. A dual-frequency planar antenna according to claim 30, wherein said second operation band is from 5370 to 6065 Mhz substantially.

33. A dual-frequency planar antenna capable of operating in a first operation band and in a second operation band, said dual-frequency planar antenna comprising:

a grounding plane;

a main radiating device coupled to said grounding plane, said main radiating device having a first resonance mode of said main radiating device such that said dual-frequency antenna is capable of operating in said first operation band;

a feeding means equipped provided on said grounding plane and coupled to said main radiating device to transfer a microwave signal to said main radiating device;

a parasitic radiating device coupled to said grounding plane and being annular and surrounding said main radiating device, said parasitic radiating device having a first resonance mode of said parasitic radiating device such that said dual-frequency antenna is capable of operating in said second operation band, wherein said first resonance mode of said parasitic radiating device is excited by the coupling of energy from said main radiating device; and a medium positioned between said main radiating device, said parasitic radiating device, and said grounding plane for isolating purposes.

wherein said main radiating device and said parasitic radiating device have a first size and a second size different from the first size, respectively; said first and said second operation bands are of a first operating frequency and a second operating frequency different from the first operating frequency, respectively; and said first and said second sizes are inversely related to said first and said second operating frequencies, respectively.

34. A dual-frequency planar antenna according to claim 33, wherein said main radiating device is circular.

35. A dual-frequency planar antenna according to claim 33, wherein said main radiating device is annular.

* * * * *